US005760670A

United States Patent [19]

Yeh et al.

[11] Patent Number: 5,760,670

[45] Date of Patent: Jun. 2, 1998

[54] TRANSFORMER CORE STRUCTURE

[75] Inventors: Ming Yeh; Y. J. Chen; H. B. Chan; Antony Du; Albert Chang, all of Taipei, Taiwan

[73] Assignee: Delta Electronics, Inc., Taipei, Taiwan

[21] Appl. No.: 792,273

[22] Filed: Jan. 31, 1997

[51] Int. Cl.[6] ..... H01F 21/06; H01F 17/06; H01F 27/24; H01F 27/30

[52] U.S. Cl. ..... 336/134; 336/212; 336/178; 336/198

[58] Field of Search ..... 336/178, 134, 336/212, 198

[56] References Cited

FOREIGN PATENT DOCUMENTS 434020A 11/1990 Japan ..... 336/208
4245607A 9/1992 Japan ..... 336/208
6-17937 6/1994 Japan ..... 336/200

*Primary Examiner*—Michael L. Gellner
*Assistant Examiner*—Anh Mai
*Attorney, Agent, or Firm*—Knobbe, Martens, Olson & Bear, LLP

[57] ABSTRACT

The present invention relates to a tranformer core structure, which includes a rectangular frame core having two long sides and two short sides, with one short side having a recessed part and the other short side being closed to form a junction surface of magnetic path; and a strip core disposed in the rectangular frame core through the recessed part, and having a length similar to that of said long side of said rectangular frame core, but having a width slightly less than that of said recessed part, wherein adjustment of the inductance of the structure is accomplished by moving said strip core along said recessed part to adjust a gap between one end of said strip core and said junction surface of magnetic path.

4 Claims, 5 Drawing Sheets

TRANSFORMER CORE STRUCTURE

FIELD OF THE INVENTION

The present invention relates to a core structure, and more particularly to a transformer core structure.

BACKGROUND OF THE INVENTION

A tranformer is an important element broadly employed in variety of electronic products. Due to the trend of reducing the size of electronic products, such as a notebook computer, a tranformer which occupies a large space in electronic products is considered to be the key factor in reducing the size of electronic products. As the core structure accounts for most of the volume in a transformer, therefore by reducing the volume of the cores, the volume of a transformer can be reduced. As shown in FIG. 1(*a*), which is a popular core structure currently used, two E-type cores are combined to form a magnetic path. When the structure is desired to be extended logitudinally to adapt to related products, the manufacturing process will become more complicated. In order to improve the above drawback, a Japan Patent No. 7-230919 has disclosed a core structure comprised mainly of a rectangular frame core 11 and an I-type core 12. The I-type core 12 is disposed on the rectangular frame core 11 through two recessed parts 111 of two short sides of the rectangular frame core to form a closed magnetic path, as shown in FIG. 1(*b*), windings 13 will be wounded around the I-type core.

However, there still exist some drawbacks in the above mentioned core structures. Whenever the inductance of a transformer is required to be adjusted, an insulating sheet 14 is inserted into the recessed part between two cores as shown in FIG. 1 (*c*), this causes a lot of inconvenience in adjusting operation. Therefore, the present invention is directed to improve the above drawback.

SUMMARY OF THE INVENTION

The present invention relates to a tranformer core structure, which comprises: a rectangular frame core having two long sides and two short sides, with one short side having a recessed part and the other short side being closed to form a junction surface of magnetic path; and a strip core disposed in said rectangular frame core through said recessed part, and having a length similar to that of said long side of said rectangular frame core, but having a width slightly less than that of said recessed part, wherein adjustment of the inductance of the structure is accomplished by moving said strip core along said recessed part to adjust a gap between one end of said strip core and said junction surface of said magnetic path.

According to the above idea, wherein said cores in said transformer core structure are made of a magnetic material.

According to the above idea, wherein the transformer core structure further comprises a bobbin to be sleeved over said strip core for winding.

According to the above idea, wherein a rib is provided on an inner wall of said bobbin.

BRIEF DESCRIPTIONS OF THE DRAWINGS

The present invention can be better understood by detailed descriptions of the following drawings, in which:

FIG. 1(*a*) and 1(*b*) are schematic diagrams of a conventional core structure.

DETAILED DESCRIPTION OF THE PREFERRED EMBODIMENT

Figure 1A:
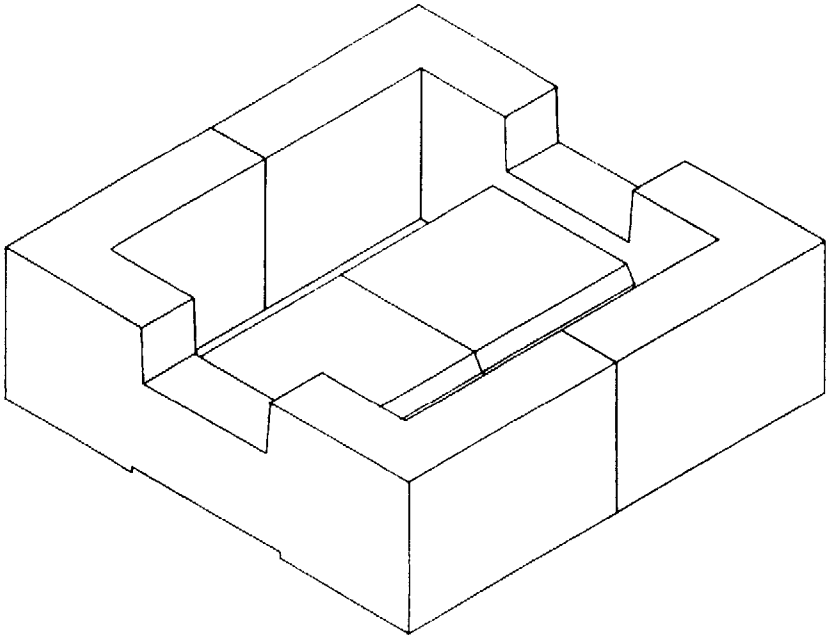
Fig. 1(a) PRIOR ART
FIG. 1(*c*) is a schematic diagram showing that an insulating sheet is inserted at the recessed part of the conventional core structure for adjusting the width of the gap.
Figure 1B:
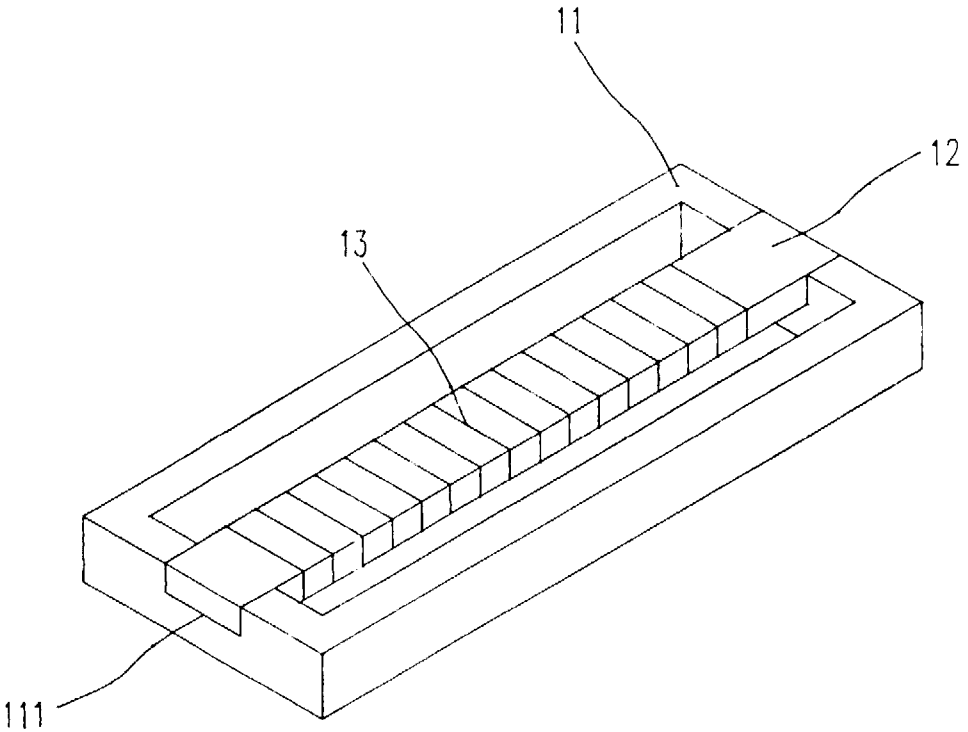
Fig. 1(b) PRIOR ART
Figure 1C:
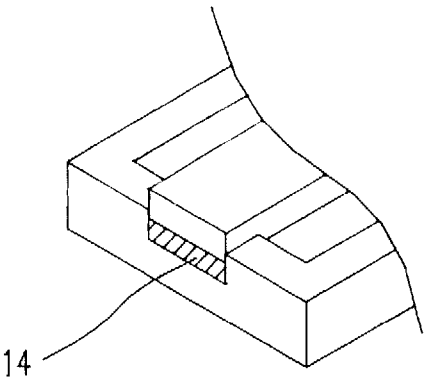
Fig. 1(c) PRIOR ART
Figure 2:
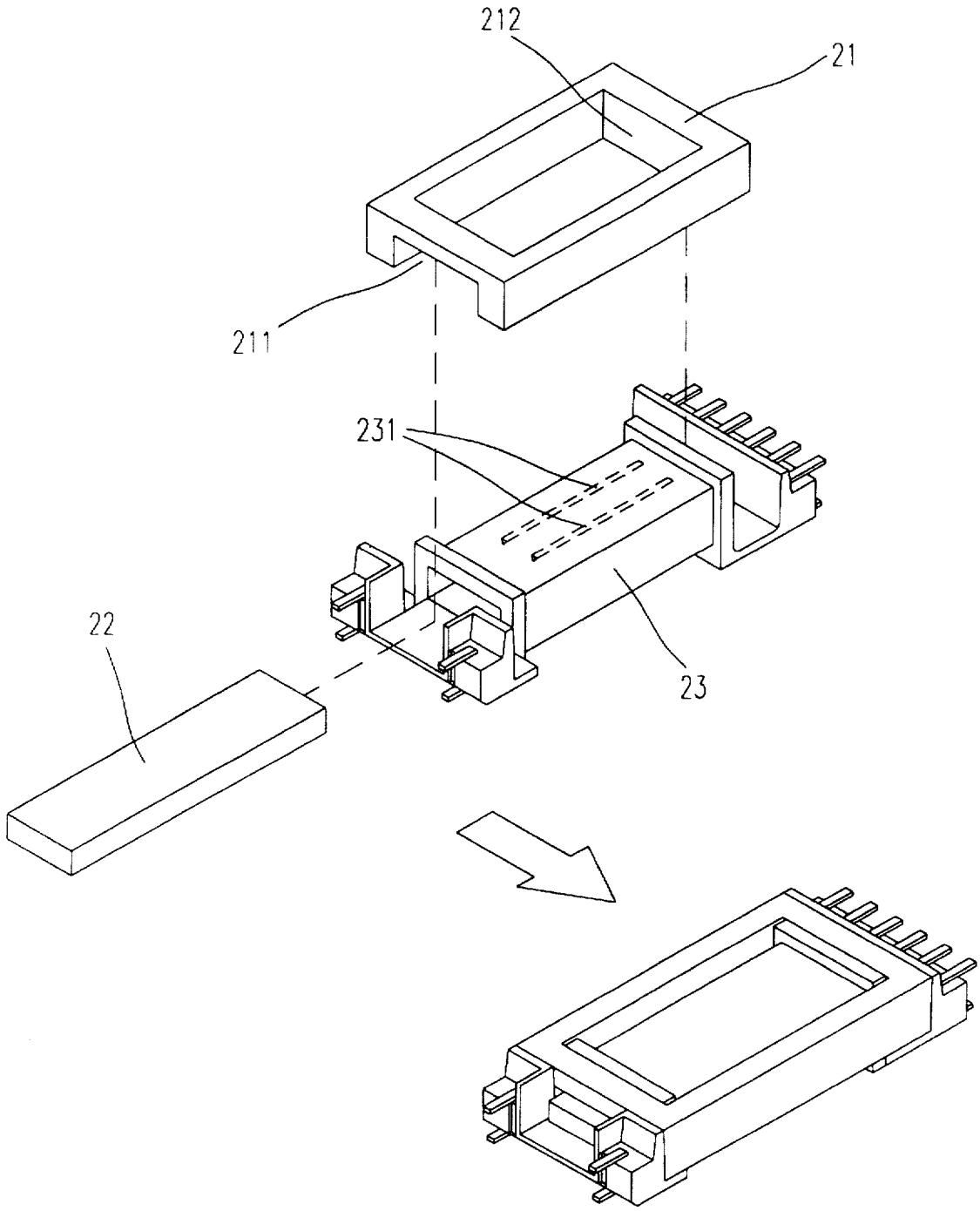
FIG. 2 is a schematic structure diagram of a preferred embodiment of the present invention.
Figure 3:
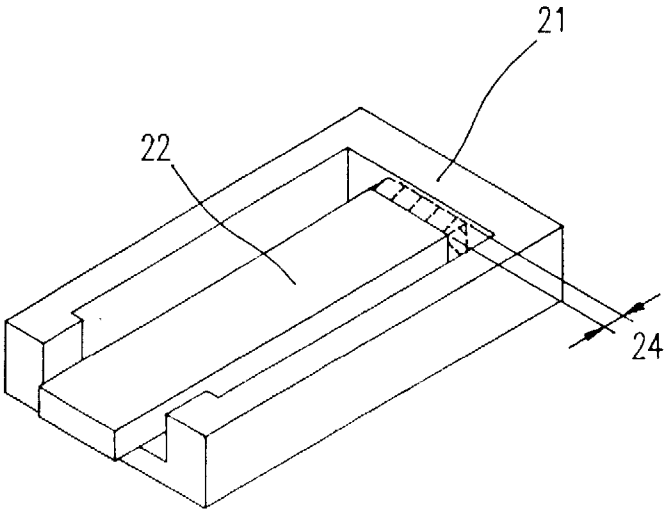
FIG. 3 is a schematic diagram showing the gap between one end of the strip core and the rectangular frame core of the preferred embodiment of the present invention.

Please refer to FIG. 2, which is a schematic structure diagram of a preferred embodiment of the present invention. A rectangular frame core 21 has only one short side being provided with a recessed part 211, while the other short side forms a junction surface 212 of magnetic path. A strip core 22 having a length similar to that of said long side of said rectangular frame core 21, but having a width slightly less than that of said recessed part 211, is disposed in said rectangular frame core 21 through said recessed part 211 to form a magnetic path. A bobbin 23 is used for being sleeved over said strip core 22 for winding. The cores 21, 22 are made of any suitable magnetized material. After assembly of the structure as shown in FIG. 2, said strip core 22 can be moved along said bobbin 23 through said recessed part 211 to adjust a gap width 24 of said magnetic path between one end of said strip core 22 and said junction surface 212 of magnetic path, and thereby vary the inductance of the transformer, as shown in FIG. 3. A rib 231 is provided on an inner wall of said bobbin 23 for increasing the stability of the gap width 24 after adjusting said strip core 22.

The above embodiments can be modified by any skillful person in the art without departing the spirit and scope of the accompanying claims.

What is claimed is:

1. A transformer core structure, comprising:

a rectangular frame core having two long elevational sides and two short elevational sides, with one short elevational side having a recessed part and the other short elevational side being closed to form a junction surface of magnetic path, said recessed part having a width; and a strip core disposed in said rectangular frame core through said recessed part, and having a length substantially the same as that of said long elevational side of said rectangular frame core and having a width slightly less than that of said recessed part, wherein adjustment of the inductance of said structure is accomplished by moving said strip core longitudinally through said recessed part to form a gap between one end of said strip core and said junction surface of magnetic path.

2. The transformer core structure according to claim 1, wherein said cores are made of a magnetic material.

3. The transformer core structure according to claim 1, wherein there further comprises a bobbin to be sleeved over said strip core for winding.

4. The transformer core structure according to claim 3, wherein a rib is provided on an inner wall of said bobbin.

* * * * *